US008844156B2

(12) United States Patent
Ghosh et al.

(10) Patent No.: US 8,844,156 B2
(45) Date of Patent: Sep. 30, 2014

(54) LAUNDRY TREATING APPLIANCE WITH PURGED CHEMISTRY CONDUITS

(75) Inventors: Kaustav Ghosh, Saint Joseph, MI (US); Thomas A. Latack, Baroda, MI (US); Robert J. Pinkowski, Baroda, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 634 days.

(21) Appl. No.: 12/967,494

(22) Filed: Dec. 14, 2010

(65) Prior Publication Data

US 2012/0144689 A1 Jun. 14, 2012

(51) Int. Cl.

| | |
|---|---|
| ***F26B 3/00*** | (2006.01) |
| ***F26B 7/00*** | (2006.01) |
| ***D06F 58/28*** | (2006.01) |
| ***D06F 58/20*** | (2006.01) |

(52) U.S. Cl.

CPC ..... *D06F 58/28* (2013.01); *D06F 58/203* (2013.01)

USPC ..... 34/330; 34/380; 34/389

(58) Field of Classification Search

USPC ..... 34/329, 330, 389, 380, 390; 68/17 R, 68/12.13

See application file for complete search history.

(56) References Cited

U.S. PATENT DOCUMENTS

| | | | | |
|---|---|---|---|---|
| 3,085,415 | A * | 4/1963 | Gosnell | 68/12.08 |
| 3,583,180 | A * | 6/1971 | Arbogast | 68/5 C |
| 3,747,645 | A | 7/1973 | Holster et al. | |
| 3,848,436 | A | 11/1974 | Rottering | |
| 3,848,437 | A | 11/1974 | Rottering | |
| 3,918,276 | A * | 11/1975 | Bruckner | 68/18 R |
| 3,962,798 | A * | 6/1976 | Jackson | 34/340 |
| 4,009,598 | A | 3/1977 | Bernard et al. | |
| 4,090,475 | A | 5/1978 | Kwan | |
| 4,845,965 | A | 7/1989 | Copeland et al. | |
| 5,014,211 | A | 5/1991 | Turner et al. | |
| 5,390,385 | A | 2/1995 | Beldham | |
| 5,505,854 | A * | 4/1996 | Glover et al. | 210/739 |
| 5,749,163 | A * | 5/1998 | Staub et al. | 34/597 |
| 5,782,109 | A | 7/1998 | Spriggs et al. | |
| 5,842,599 | A | 12/1998 | Douma et al. | |
| 5,873,268 | A | 2/1999 | Spriggs et al. | |
| 5,975,352 | A | 11/1999 | Spriggs et al. | |
| 5,980,583 | A * | 11/1999 | Staub et al. | 8/149.2 |
| 6,143,257 | A | 11/2000 | Spriggs et al. | |
| 7,047,663 | B2 * | 5/2006 | Zhang et al. | 34/348 |
| 7,066,412 | B2 * | 6/2006 | Conley et al. | 239/690 |
| 7,380,423 | B1 * | 6/2008 | Musone | 68/20 |
| 7,658,088 | B2 | 2/2010 | Walker et al. | |
| 2003/0050220 | A1 * | 3/2003 | Trinh et al. | 510/521 |
| 2005/0166644 | A1 * | 8/2005 | Gerald France et al. | 68/12.04 |
| 2005/0183208 | A1 * | 8/2005 | Scheper et al. | 8/142 |
| 2006/0272360 | A1 | 12/2006 | Hsu et al. | |

(Continued)

FOREIGN PATENT DOCUMENTS

| | | | |
|---|---|---|---|
| DE | 102008004258 | A1 | 10/2008 |
| EP | 0711367 | A1 | 5/1996 |

(Continued)

*Primary Examiner* — Kenneth Rinehart
*Assistant Examiner* — John McCormack

(57) ABSTRACT

A method of operating a clothes dryer having a rotating drum defining a drying chamber without a liquid drain, an air system, a heating system, a treating chemistry dispensing system, and a controller, where a purge detection routine and purge cycle are executed to purge the treating chemistry from clothes dryer without draining.

32 Claims, 4 Drawing Sheets

(56) References Cited

U.S. PATENT DOCUMENTS

| | | | | |
|---|---|---|---|---|
| 2009/0071032 | A1 | 3/2009 | Kreutzfeldt et al. | |
| 2009/0090141 | A1 * | 4/2009 | Deppermann et al. | 68/17 R |
| 2009/0119849 | A1 | 5/2009 | Hill et al. | |
| 2009/0272003 | A1 * | 11/2009 | Dalton et al. | 34/329 |
| 2009/0272004 | A1 | 11/2009 | Chernetski et al. | |
| 2009/0308111 | A1 | 12/2009 | Robb et al. | |
| 2009/0317311 | A1 | 12/2009 | Cocking et al. | |
| 2010/0000024 | A1 | 1/2010 | Hendrickson et al. | |
| 2010/0000114 | A1 | 1/2010 | Dalton et al. | |
| 2010/0000115 | A1 | 1/2010 | Chernetski et al. | |
| 2010/0000578 | A1 | 1/2010 | Hendrickson et al. | |
| 2010/0011607 | A1 | 1/2010 | Kim et al. | |
| 2010/0011611 | A1 | 1/2010 | Kim et al. | |

FOREIGN PATENT DOCUMENTS

| | | | |
|---|---|---|---|
| EP | 1688529 | A1 | 8/2006 |
| EP | 1923499 | A1 | 5/2008 |
| EP | 2080832 | A1 | 7/2009 |
| EP | 2133457 | A1 | 12/2009 |
| EP | 2169104 | A1 | 3/2010 |
| GB | 2159125 | A | 11/1985 |
| KR | 20050022626 | A | 3/2005 |
| KR | 20070059426 | A | 6/2007 |
| WO | 95/04183 | A1 | 2/1995 |
| WO | 03/027377 | A1 | 4/2003 |
| WO | 2009/010402 | A1 | 1/2009 |
| WO | 2009/021874 | A1 | 2/2009 |

* cited by examiner

LAUNDRY TREATING APPLIANCE WITH PURGED CHEMISTRY CONDUITS

BACKGROUND OF THE INVENTION

Contemporary laundry treating appliances, such as clothes dryers, may be provided with a treating chamber for receiving a laundry load for treatment, such as drying. The laundry load may be treated in the treating chamber using one or more treating chemistries according to a cycle of operation. The treating chemistry may be dispensed to the treating chamber through one or more conduits.

SUMMARY OF THE INVENTION

A method of operating a clothes dryer comprising executing a purge detection routine to detect a purge condition in a dispensing system, automatically executing a purge cycle to purge at least a portion of a supply conduit of the dispensing system, and removing the purged treating chemistry from the clothes dryer without draining the purged treating chemistry from the treating chamber.

DESCRIPTION OF EMBODIMENTS OF THE INVENTION

Figure 1:
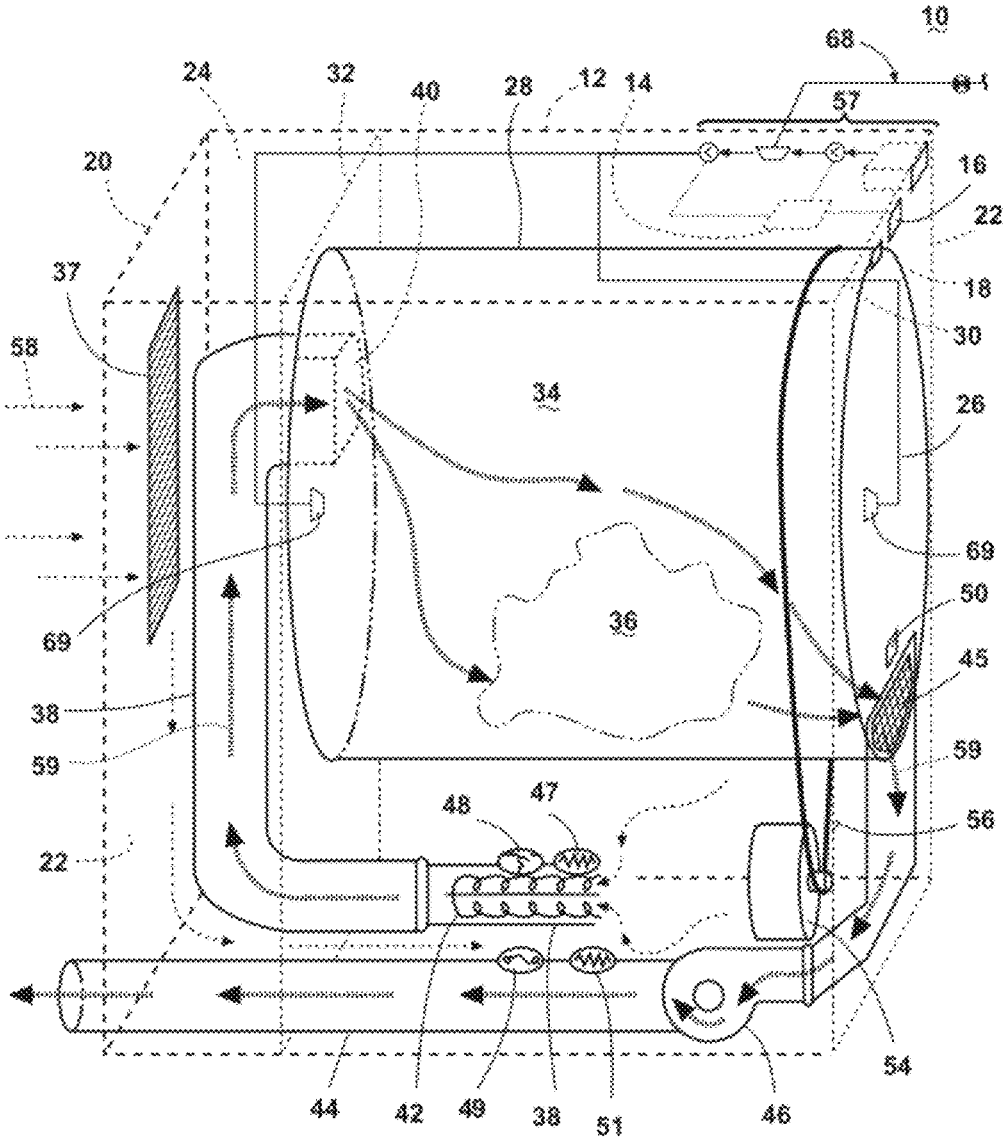
FIG. 1 is a schematic perspective view of a laundry treating appliance in the form of a clothes dryer according to an embodiment of the invention.

FIG. 1 is a schematic view of a laundry treating appliance 10 in the form of a clothes dryer 10 according to a first embodiment of the invention. The clothes dryer 10 described herein shares many features of a traditional automatic clothes dryer, which will not be described in detail except as necessary for a complete understanding of the invention.

As illustrated in FIG. 1, the clothes dryer 10 may include a cabinet 12 in which is provided a controller 14 that may receive input from a user through a user interface 16 for selecting a cycle of operation and controlling the operation of the clothes dryer 10 to implement the selected cycle of operation.

The cabinet 12 may be defined by a front wall 18, a rear wall 20, and a pair of side walls 22 supporting a top wall 24. A chassis may be provided with the walls being panels mounted to the chassis. A door 26 may be hingedly mounted to the front wall 18 and may be selectively movable between opened and closed positions to close an opening in the front wall 18, which provides access to the interior of the cabinet 12.

A rotatable drum 28 may be disposed within the interior of the cabinet 12 between opposing stationary rear and front bulkheads 30, 32, which collectively define a treating chamber 34, for treating laundry 36, having an open face that may be selectively closed by the door 26. The treating chamber 34 is not fluidly coupled to a drain.

Examples of laundry include, but are not limited to, a hat, a scarf, a glove, a sweater, a blouse, a shirt, a pair of shorts, a dress, a sock, a pair of pants, a shoe, an undergarment, and a jacket. Furthermore, textile fabrics in other products, such as draperies, sheets, towels, pillows, and stuffed fabric articles (e.g., toys), may be dried in the clothes dryer 10.

The drum 28 may include at least one lifter (not shown). In most dryers, there may be multiple lifters. The lifters may be located along the inner surface of the drum 28 defining an interior circumference of the drum 28. The lifters may facilitate movement of the laundry 36 within the drum 28 as the drum 28 rotates.

The drum 28 may be operably coupled with a motor 54 to selectively rotate the drum 28 during a drying cycle. The coupling of the motor 54 to the drum 28 may be direct or indirect. As illustrated, an indirect coupling may include a belt 56 coupling an output shaft of the motor 54 to a wheel/pulley on the drum 28. A direct coupling may include the output shaft of the motor 54 coupled to a hub of the drum 28.

An air system may be provided to the clothes dryer 10. The air system supplies air to the treating chamber 34 and exhausts air from the treating chamber 34. The supplied air may be heated or not. The air system may have an air supply portion that may form in part a supply conduit 38, which has one end open to ambient air via a rear vent 37 and another end fluidly coupled to an inlet grill 40, which may be in fluid communication with the treating chamber 34. A heating element 42 may lie within the supply conduit 38 and may be operably coupled to and controlled by the controller 14. If the heating element 42 is turned on, the supplied air will be heated prior to entering the drum 28.

The air system may further include an air exhaust portion that may be formed, in part, by an exhaust conduit 44. A lint trap 45 may be provided as the inlet from the treating chamber 34 to the exhaust conduit 44. A blower 46 may be fluidly coupled to the exhaust conduit. The blower 46 may be operably coupled to and controlled by the controller 14. Operation of the blower 46 draws air into the treating chamber 34 as well as exhausts air from the treating chamber 34 through the exhaust conduit 44. The exhaust conduit 44 may be fluidly coupled with a household exhaust duct or exhausting the air from the treating chamber 34 to the outside the clothes dryer 10.

The air system may further include various sensors and other components, such as a thermistor 47 and a thermostat 48, which may be coupled to the supply conduit 38 in which the heating element 42 may be positioned. The thermistor 47 and the thermostat 48 may be operably coupled to each other. Alternatively, the thermistor 47 may be coupled to the supply conduit 38 at or near to the inlet grill 40. Regardless of its location, the thermistor 47 may be used to aid in determining the inlet temperature. A thermistor 51 and thermal fuse 49 may be coupled to the exhaust conduit 44, with the thermistor 51 being used to determine the outlet air temperature. A moisture sensor 50 may be positioned in the interior of the treating chamber 34 to monitor the amount of moisture of the laundry in the treating chamber 34.

A dispensing system 57 may be provided to the clothes dryer 10 to dispense one or more treating chemistries to the treating chamber 34 according to a cycle of operation. As illustrated, the dispensing system 57 may be located in the interior of the cabinet 12 although other locations are also possible. The dispensing system 57 may be fluidly coupled to a water supply 68. The dispensing system 57 may be further coupled to the treating chamber 34 through a pair of nozzles 69 while other nozzle configurations in terms of number, including just one or more nozzles, and/or location of nozzle (s) and are also possible.

Figure 2:
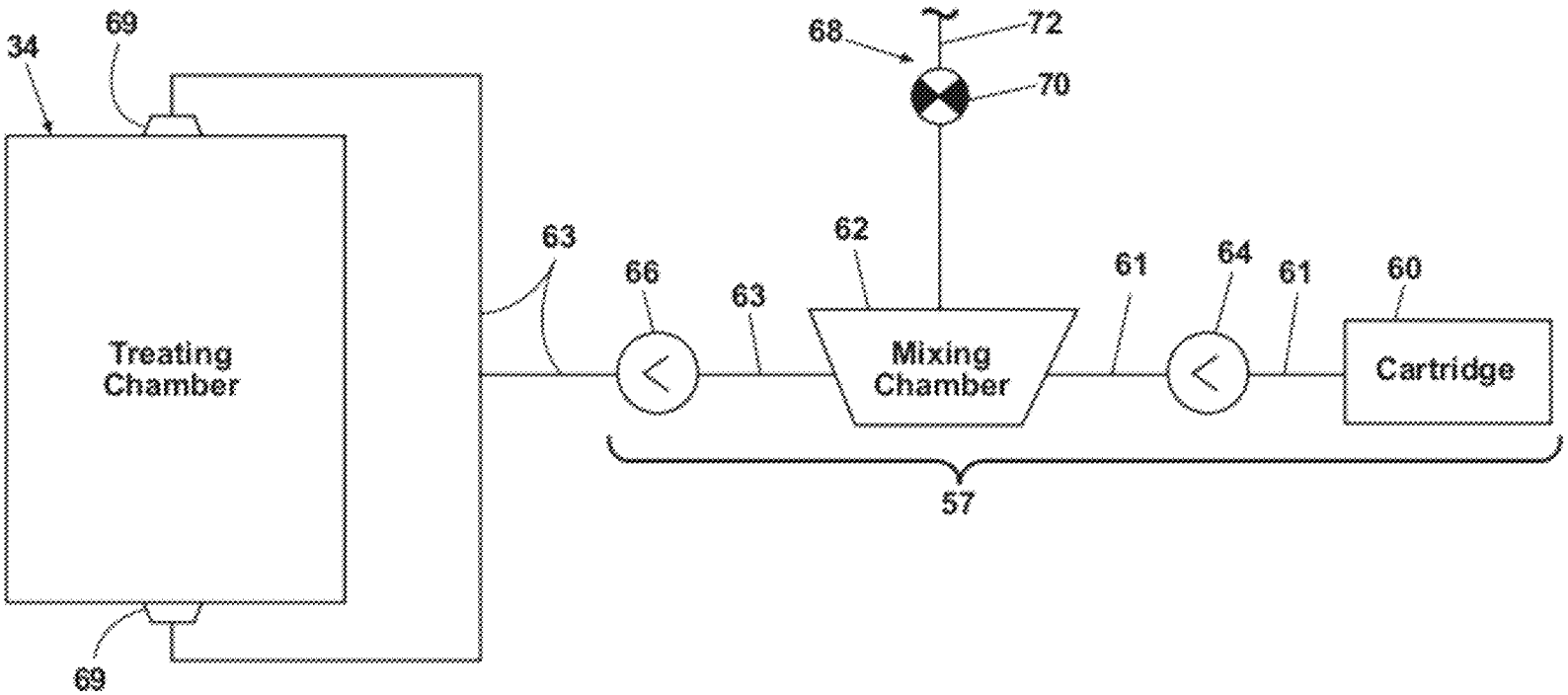
FIG. 2 is a schematic of a dispensing system for the clothes dryer of FIG. 1.

Referring to FIG. 2, the details of the dispensing system 57 will be described. The dispensing system 57 may include a reservoir 60, which may be a cartridge, for a treating chemistry that is releasably coupled to the dispensing system 57, which dispenses the treating chemistry from the reservoir 60 to the treating chamber 34.

The treating chemistry may be any type of aid for treating laundry, and non-limiting examples include, but are not limited to, fabric softeners, sanitizers, de-wrinklers, whitening agent, and chemicals for imparting desired properties to the laundry, including stain resistance, fragrance (e.g., perfumes), insect repellency, and UV protection.

The reservoir 60 may include one or more cartridges configured to store one or more treating chemistries in the interior of cartridges. A suitable cartridge system may be found in U.S. application Ser. No. 12/165,712, which published as US 2010/0000022A1, which is incorporated by reference in its entirety. A mixing chamber 62 may be provided to couple the reservoir 60 to the treating chamber 34 through supply conduits 61, 63. Pumps such as a metering pump 64 and delivery pump 66 may be provided to the dispensing system 57 to selectively supply a treating chemistry and/or liquid to the treating chamber 34 according to a cycle of operation.

The water supply 68 may be fluidly coupled to the mixing chamber 62 to provide water from the water source to the mixing chamber 62. The water supply 68 may include an inlet valve 70 and a water supply conduit 72. It is noted that, instead of water, a different treating chemistry may be provided from the exterior of the treating chamber 34 to the mixing chamber 62.

The nozzles 69 may couple the treating chamber 34 to the supply conduit 63. As illustrated, two nozzles 69 are provided to the front and rear of the treating chamber 34 to provide the treating chemistry or liquid to the interior of the treating chamber 34 although other configurations are also possible.

Figure 3:
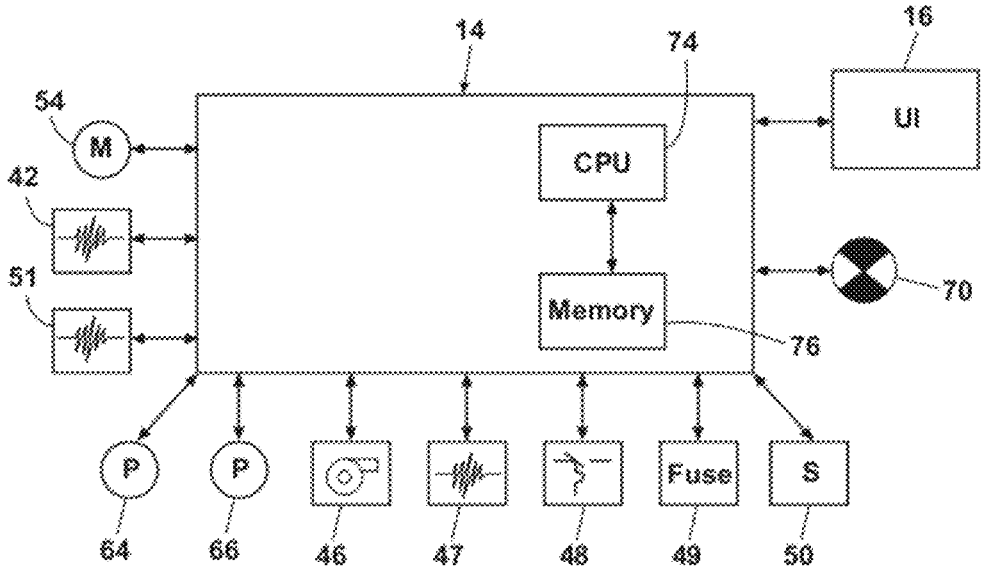
FIG. 3 is a schematic of a controller of the clothes dryer in FIG. 1.

FIG. 3 is a schematic view of the controller 14 coupled to the various components of the dryer 10. The controller 14 may be communicably coupled to components of the clothes dryer 10 such as the heating element 42, blower 46, thermistor 47, thermostat 48, thermal fuse 49, thermistor 51, motor 54, inlet valve 70, and pumps 64, 66 to either control these components and/or receive their input for use in controlling the components. The controller 14 is also operably coupled to the user interface 16 to receive input from the user through the user interface 16 for the implementation of the drying cycle and provide the user with information regarding the drying cycle.

The user interface 16 may be provided having operational controls such as dials, lights, knobs, levers, buttons, switches, and displays enabling the user to input commands to a controller 14 and receive information about a drying cycle from components in the clothes dryer 10 or via input by the user through the user interface 16. The user may enter many different types of information, including, without limitation, cycle selection and cycle parameters, such as cycle options. Any suitable cycle may be used. Non-limiting examples include, Casual, Delicate, Super Delicate, Heavy Duty, Normal Dry, Damp Dry, Sanitize, Quick Dry, Timed Dry, and Jeans.

The controller 14 may implement a drying cycle selected by the user according to any options selected by the user and provide related information to the user. The controller 14 may also comprise a central processing unit (CPU) 74 and an associated memory 76 where various drying cycles and associated data, such as look-up tables, may be stored. One or more software applications, such as an arrangement of executable commands/instructions may be stored in the memory and executed by the CPU 74 to implement the one or more drying cycles.

In general, the controller 14 will effect a cycle of operation to effect a treating of the laundry in the treating chamber 34, which may or may not include drying. The controller 14 may actuate the blower 46 to draw air into the supply conduit 38 through the rear vent 37 when air flow is needed for a selected treating cycle. The controller 14 may activate the heating element 42 to heat the inlet air flow as it passes over the heating element 42, with the heated air being supplied to the treating chamber 34. The thermistor 47 may sense the temperature of inlet air that passes through the supply conduit 38 and send to the controller 14 a signal indicative of the sensed temperature. The heated air may be in contact with a laundry load 36 as it passes through the treating chamber 34 on its way to the exhaust conduit 44 to effect a moisture removal of the laundry. The air may exit the treating chamber 34, and flow through blower 46 and the exhaust conduit 44 to the outside the clothes dryer 10. The controller 14 continues the cycle of operation until completed. If the cycle of operation includes drying, the controller 14 determines when the laundry is dry. The determination of a "dry" load may be made in different ways, but is often based on the moisture content of the laundry, which is typically set by the user based on the selected cycle, an option to the selected cycle, or a user-defined preference.

During a cycle of operation, one or more treating chemistries may be provided in the interior of the treating chamber 34 by the dispensing system 57 as actuated by the controller 14. To dispense the treating chemistry, the metering pump 64 is actuated by the controller 14 to pump a predetermined dose of the treating chemistry stored in the cartridge 60 to the mixing chamber 62, which may be provided as a single charge, multiple charges, or at a predetermined rate, for example.

Depending on a cycle of operation, liquid such as water or a different treating chemistry may be provided to the mixing chamber 62, irrespective of the presence of a treating chemistry. For example, water may be mixed with the treating chemistry in the mixing chamber 62 before a mixture of the treating chemistry and water is pumped to the treating chamber 34 by the delivery pump 66 through the supply conduit 63. Alternatively, water may be provided to the mixing chamber 62 after the mixture is provided to the treating chamber 34, to purge the remaining mixture from the supply conduit 63 and fill the supply conduit 63 mainly with water. The water may be also supplied to the interior of the treating chamber 34 according to a cycle of operation. It is contemplated that the mixing chamber 62 will be used to reduce the concentration of the treating chemistry because many treating chemistries are provided in the cartridge at concentrations that are too high to directly apply to the laundry, but which saves shipping costs and provides a more convenient size for the cartridge. The addition of water with the treating chemistry provides for reducing the concentration to a non-deleterious concentration.

Figure 4:
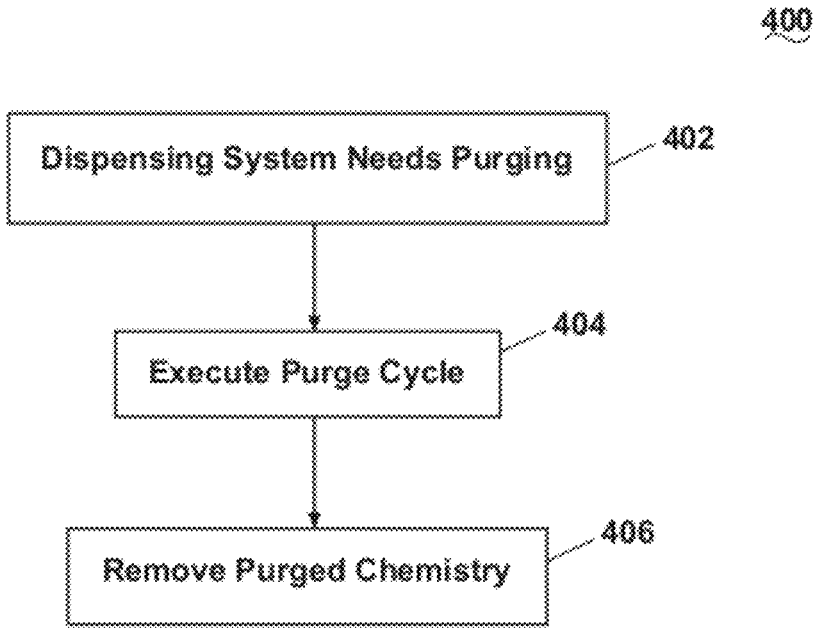
FIG. 4 is a flow chart for operating the clothes dryer according to another embodiment of the invention.

FIG. 4 is a flow chart for operating the clothes dryer 10 according to another embodiment of the invention. The sequence of steps depicted in FIG. 4 is for illustrative purposes only, and is not meant to limit the method in any way as it is understood that the steps may proceed in a different logical order, additional or intervening steps may be included, or described steps may be divided into multiple steps, without detracting from the invention. The method may be incorporated into a cycle of operation for the clothes dryer 10, such as prior to, during, or after any phase of the treatment cycle. Alternatively, the method may also be a stand-alone cycle.

The method 400 may begin at 402 by detecting that the dispensing system 57 needs purging. A purging condition may arise during the operation of the clothes dryer 10, when an old treating chemistry is changed to a new treating chemistry, especially when the treating chemistries are different. The treating chemistry may be changed by replacing the old cartridge having the old treating chemistry with the new cartridge having the new treating chemistry.

When a treating chemistry is used in the clothes treating appliance, such as a clothes dryer 10, a portion of the clothes dryer 10, such as supply conduit 61, 63 in the dispensing system 57, may contain residual amounts of the old chemistry that may contaminate the new treating chemistry. Therefore, before a new treating chemistry is provided to the laundry through a portion of the clothes dryer 10, the portion of the clothes dryer 10, with which the treating chemistry is fluidly contacting, needs to be purged to minimize the possibility of any cross-contamination between dissimilar treating chemistries.

Purging, as used in this description, means to render the treating chemistry harmless to either the laundry or the subsequently dispensed treating chemistry, which includes, but is not limited to, flushing the treating chemistry. The treating chemistry may also be rendered harmless by diluting the chemistry to a concentration and its application to the laundry or mixing with another chemistry will not have deleterious effects, such as not be visible to the consumer.

In another example, the user may need to cancel the dispensing of the treating chemistry into the treating chamber 34 after the treating chemistry is already provided into the mixing chamber 62 through the supply conduit 61 and/or any pump such as the metering pump 64. For example, the user may change his/her mind to use a different treating chemistry after he/she already dispensed a treating chemistry into the mixing chamber 62. In another example, the user may simply not wish to implement a cycle of operation, or may wish to hold the cycle of operation. Under these conditions, it is highly probable that a portion of the dispensing system 57 may be already contaminated with the treating chemistry, and the purging step may be necessary.

Determining as to whether the dispensing system 57 needs to be purged may be implemented automatically by the components of the clothes dryer 10, while the user may determine the execution of a purging cycle through the user interface 16. For example, a position sensor may automatically sense the removal of the cartridge 60 and send the output signal indicative of the removal of the cartridge 60 to the controller 14 when a cartridge 60 is removed from the dispensing system 57. The user may press a "cancel" button or similar input on the user interface 16 to indicate the desire to cancel the dispensing, which may be used as input that a purge condition exists. The user may also select a "purge" button or similar input on the user interface 16 to indicate that a purge condition exists.

At 404, a purge cycle may be executed when a purge condition exists. The purge cycle may include moving at least a portion of the treating chemistry from one part of the clothes dryer 10 to another. The execution of the purge cycle may include pumping the treating chemistry from a portion of the supply conduit 61 upstream of the mixing chamber 62 into the mixing chamber 62. In the case of a swapping of cartridges, if the new cartridge is coupled to the supply conduit 61, the new chemistry will replace the old chemistry in the supply conduit 61 up to the mixing chamber 62.

The purge cycle may also be executed by providing a controlled dose of liquid, such as water or different treating chemistry supplied, to the mixing chamber 62, regardless of the presence of a treating chemistry in the mixing chamber 62. The mixture in the mixing chamber 62 may then be supplied to the treating chamber 34 to flush out the supply conduit 63 from the mixing chamber 62 to the treating chamber 34.

The purge cycle may be further executed by supplying the treating chemistry to the mixing chamber 62 and mixing with liquid supplied to form a mixture of treating chemistry and liquid. Under this condition, the mixture may have a reduced concentration of the treating chemistry, compared with the treating chemistry stored in the cartridge 60. For example, the amount of liquid such as water or a different treating chemistry supplied from exterior of the clothes dryer 10 may be a sufficient amount such that the concentration of the treating chemistry in the mixture may not have any user-perceivable effect on the laundry in the treating chamber 34. Therefore, if the treating chemistry is a fragrance, the user may not perceive the smell of the fragrance sufficiently diluted with liquid and provided into the treating chamber 34.

The execution of the purge cycle may further include holding the treating chemistry in the mixing chamber 62 until a subsequent cycle of operation. A subsequent cycle of operation may be implemented using the treating chemistry or the mixture held in the mixing chamber 62 to treat a laundry load in the treating chamber 34.

In still another example, the execution of the purge cycle includes dispensing the mixture in the mixing chamber 62, including any treating chemistry and supplied liquid, through the supply conduit 63 into the treating chamber 34. Alternatively, the mixture may be dispensed into the treating chamber 34, followed by dispensing of the water or a different treating chemistry through the supply conduit 63 into the treating chamber 34, to purge any treating chemistry potentially remaining in the supply conduit 63.

All of the previously described purges may be combined in whole or in part as need be for the given circumstance.

Once the purge cycle is executed at 404, the purged treating chemistry or mixture may be removed at 406. For example, the mixture including a treating chemistry and liquid may be removed by applying the mixture onto the laundry stored in the treating chamber 34. In another example, a predetermined amount of additional liquid may be applied after the mixture is provided to the laundry in the treating chamber 34, to further dilute the mixture.

Applying the mixture or liquid, for example by spraying, may be implemented at a predetermined temperature for a predetermined time, depending on the physical properties, such as a boiling point or vapor pressure, of a treating chemistry or the mixture. For example, if the boiling point of the treating chemistry is high compared to other treating chemistries, the temperature may be set high enough such that the treating chemistry may be evaporated in a reduced time period.

In another embodiment, the treating chemistry may be removed by evaporating the mixture including a treating chemistry and liquid from the treating chamber 34. The evaporation of the mixture may be implemented regardless of the presence of a laundry load inside the treating chamber 34.

The treating chamber 34 may rotate at a predetermined speed while the mixture is evaporated from the treating chamber 34. The treating chamber 34 may be further provided with heated air heated by the heating element 42 during the rotation of the treating chamber 34 to further promote the evaporation of the mixture from the treating chamber 34. Under this condition, a predetermined temperature of the heated air may be set such that at least a portion of the mixture may evaporate from the interior of the treating chamber 34.

As described above, the treating chemistry may be removed by applying the mixture on the laundry or evaporating the mixture in the treating chamber 34. However, it is noted that mixture of two embodiments may be also implemented to remove the treating chemistry from the treating chamber 34. For example, a portion of the mixture of liquid may be sprayed on the laundry, and subsequently a portion of the mixture of liquid may be evaporated at a predetermined temperature for a predetermined time while the treating chamber 34 is provided with hot air to evaporate the liquid from the treating chamber 34.

While the previously described purging conditions, purging, and removal of purged chemistry may be combined into any possible combinations, three combinations are anticipated to most likely occur during the anticipated operation of the dryer 10.

In one scenario, the user may replace an old cartridge in the dispensing system 57 with a new cartridge to implement a new cycle of operation after the user implemented a cycle of operation using the old cartridge. When the user changes the cartridge, a sensor may sense the removal of the cartridge from the dispensing system 57. The metering pump 64 may communicate with the controller 14, and pump remaining old treating chemistry in the supply conduit 61 to the mixing chamber 62. The old chemistry may be diluted with a sufficient amount of water to a sufficiently reduced concentration level in the mixing chamber 62. The diluted old chemistry may be pumped to the laundry load in the treating chamber 34 and may be thermally dried off. Alternatively, the diluted old treating chemistry may be added in the pre-wetting step prior to applying the new treating chemistry to the laundry load.

In another scenario, it is assumed that the treating chemistry is already provided to the mixing chamber 62 according to a cycle of operation. Then the user may change his/her mind and cancel the cycle of operation. Under this condition, only the treating chemistry may be in the mixing chamber 62 while the treating chemistry may be already mixed with liquid such as water or different treating chemistry in the mixing chamber 62. Once the cycle is canceled, the treating chemistry in the treating chamber 34 may be held until the treating chemistry is needed or dispensed at the start of the next cycle.

In yet another scenario, the user may choose a no fragrance or low fragrance cycle, and avoid dripping a treating chemistry such as the fragrance or whitening agent from the nozzles 69 of the dispensing system 57 onto the laundry load in the treating chamber 34. The mixing chamber 62 may be configured to fill with enough amount of liquid at the end of the delivery step of the treating chemistry to dilute any highly concentrated treating chemistry to a low or no concentration level. When the delivery pump 66 runs, all of the treating chemistry may be purged from the supply conduit 63 and essentially only liquid may follow the treating chemistry in the supply conduit 63. Under this condition, any highly concentrated treating chemistry from the supply conduit 63 may be prevented from dripping to the laundry load. Therefore, this embodiment may guarantee a controlled fragrance cycle whenever the no or low fragrance cycle is implemented. The liquid that is applied to the laundry load may be evaporated during a typical drying cycle that follows the purge cycle.

It is noted that removal of the treating chemistry in a dryer is not as easy or simple as other laundry treating appliances with a drain, such as a washing machine. In a washing machine, removing unwanted treating chemistry is fairly easy and can be done without concern for applying the treating chemistry to the laundry. In a washing machine, the treating chemistry is typically introduced into a tub, which surrounds the drum holding the laundry. As the tub has a drain, the treating chemistry may be dispensed into the tub and then drained away. Additional water may be supplied to the tub as part of a flushing or diluting process and also drained away. This can all be done without the treating chemistry and flushing water being applied to the laundry, which is not possible in a dryer.

Thus, evaporating the unwanted liquid in a dryer becomes a useful method for removing the unwanted chemistry. However, such an approach has practical or commercial constraints in that the more unwanted liquid applied to the laundry, the longer will be the cycle time, which is very undesirable for most consumers, not to mention the increased power consumption for drying. Thus, the purging with liquid and removal with evaporation as contemplated by the invention should be done with an eye towards reducing the additional liquid added to reduce the negative impact on drying time and energy consumption. This is especially true since dispensing dryers tend to have special cycles, such as dewrinkling or refreshing, which are expected to have relatively short cycle times.

The application of the unwanted treating chemistry to the treating chamber and its removal by evaporation is also concerned with avoiding the drying of residual chemistry on the surfaces of the treating chamber, which may function to spot treat subsequent laundry placed in the dryer.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention which is defined in the appended claims.

What is claimed is:

1. A method of operating a clothes dryer comprising a rotating drum defining a drying chamber without a liquid drain, an air system supplying air to and exhausting air from the drying chamber, a heating system for heating the air in the air system, a treating chemistry dispensing system having a treating chemistry supply conduit fluidly coupled to the treating chamber for dispensing a treating chemistry into the treating chamber, and a controller for controlling the operation of the drum, air system, heating system and dispensing system to at least one treating cycle of operation, the method comprising:

automatically executing a purge detection routine to detect a purge condition during the operation of the clothes dryer indicative of a need to purge the supply conduit of treating chemistry;

automatically executing a purge cycle to purge at least a portion of the supply conduit of treating chemistry in response to the automatic detection of the purge condition; and removing the purged treating chemistry from the clothes dryer without draining the purged treating chemistry from the treating chamber.

2. The method of claim 1 wherein the purge detection routine comprises detecting removal of a chemistry cartridge from the treating chemistry dispensing system.

3. The method of claim 2 wherein executing the purge cycle comprises pumping into a mixing chamber, the treating chemistry from a portion of the supply conduit upstream of the mixing chamber.

4. The method of claim 3 wherein executing the purge cycle further comprises supplying a liquid to the mixing chamber to form a mixture having a reduced concentration of the treating chemistry.

5. The method of claim 4 wherein the amount of liquid supplied is sufficient such that the resulting concentration of the treating chemistry in the mixture has a user-imperceptible effect on laundry in the treating chamber.

6. The method of claim 4 wherein executing the purge cycle further comprises dispensing the mixture into the treating chamber.

7. The method of claim 6 wherein the removal of the treating chemistry comprises evaporating at least a portion of the mixture from the treating chamber.

8. The method of claim 7 wherein the removal of the treating chemistry comprises applying at least a portion of the mixture to laundry.

9. The method of claim 8 wherein the removal of the treating chemistry further comprises evaporating at least a portion of the mixture from the treating chamber.

10. The method of claim 1 wherein the purge detection routine comprises detecting cancellation of a dispensing of the treating chemistry by a user.

11. The method of claim 10 wherein executing the purge cycle comprises dispensing the treating chemistry from the supply conduit into a mixing chamber.

12. The method of claim 11 wherein executing the purge cycle further comprises holding the treating chemistry in the mixing chamber until a subsequent cycle of operation.

13. The method of claim 12 wherein executing the purge cycle further comprises supplying a liquid to the mixing chamber to form a mixture having a reduced concentration of the treating chemistry.

14. The method of claim 13 wherein the amount of liquid supplied is sufficient such that the resulting concentration of the treating chemistry in the mixture has a user-imperceptible effect on a laundry in the treating chamber.

15. The method of claim 14 wherein executing the purge cycle further comprises dispensing the treating chemistry into the treating chamber.

16. The method of claim 15 wherein the removal of the treating chemistry comprises evaporating at least a portion of the mixture from the treating chamber.

17. The method of claim 16 wherein the removal of the treating chemistry comprises applying at least a portion of the mixture to the laundry.

18. The method of claim 17 wherein the removal of the treating chemistry further comprises evaporating at least a portion of the mixture from the treating chamber.

19. The method of claim 1 wherein executing the purge cycle comprises flushing at least a portion of the supply conduit with liquid to form a mixture of liquid and treating chemistry.

20. The method of claim 19 wherein the liquid is water.

21. The method of claim 20 wherein the liquid is a different treating chemistry.

22. The method of claim 19 wherein executing the purge cycle comprises introducing the mixture into the treating chamber.

23. The method of claim 19 wherein flushing at least a portion of the supply conduit comprises flushing the treating chemistry into a mixing chamber.

24. The method of claim 23 wherein executing a purge cycle further comprises holding the treating chemistry in the mixing chamber until a subsequent cycle of operation.

25. The method of claim 24 wherein executing a purge cycle further comprises adding a liquid to the mixing chamber to form a mixture with a diluted concentration of the treating chemistry.

26. The method of claim 25 wherein the amount of the liquid added results in the mixture having a treating chemistry concentration with a user-imperceptible effect on a laundry in the treating chamber.

27. The method of claim 19 wherein the amount of the liquid added during flushing results in the mixture of liquid and treating chemistry having a concentration of the treating chemistry with a user-imperceptible effect on a laundry in the treating chamber.

28. The method of claim 1 wherein removing the purged treating chemistry from the clothes dryer comprises evaporating a mixture from the treating chamber.

29. The method of claim 28 wherein evaporating the mixture from the treating chamber comprises rotating the treating chamber.

30. The method of claim 29 wherein evaporating the mixture from the treating chamber comprises supplying the air to the treating chamber during the rotation of the treating chamber.

31. The method of claim 30 wherein evaporating the mixture from the treating chamber comprises heating the air supplied to the treating chamber.

32. The method of claim 28 wherein evaporating the mixture from the treating chamber comprises evaporating the mixture without the presence of laundry in the treating chamber.

* * * * *